US006415920B1

(12) United States Patent
Tiramani et al.

(10) Patent No.: US 6,415,920 B1
(45) Date of Patent: Jul. 9, 2002

(54) CONTAINER AND FOLDABLE PANEL EMPLOYING A PLURALITY OF GAS POCKETS

(75) Inventors: Paolo M. B. Tiramani; John A. Bozak, both of Greenwich; Soohyun Ham, Stamford, all of CT (US)

(73) Assignee: 500 Group, Inc., Greenwich, CT (US)

( * ) Notice: Subject to any disclaimer, the term of this patent is extended or adjusted under 35 U.S.C. 154(b) by 0 days.

(21) Appl. No.: 09/716,505

(22) Filed: Nov. 20, 2000

Related U.S. Application Data

(62) Division of application No. 08/815,378, filed on Mar. 11, 1997, now Pat. No. 6,149,002.

(51) Int. Cl.[7] ..... B65D 81/02
(52) U.S. Cl. ..... 206/320; 206/592; 206/594
(58) Field of Search ..... 206/320, 521, 206/576, 591, 592, 593, 594, 522

(56) References Cited

U.S. PATENT DOCUMENTS

| | | | |
|---|---|---|---|
| 3,142,599 | A | 7/1964 | Chavannes |
| 3,744,627 | A | 7/1973 | Rope et al. |
| 4,044,867 | A | 8/1977 | Fisher |
| 4,093,068 | A | 6/1978 | Smrt |
| 4,344,536 | A | 8/1982 | Oberhuber |
| 4,377,598 | A | 3/1983 | Nugent |
| 4,428,484 | A | 1/1984 | Rattay et al. |
| 4,664,262 | A | 5/1987 | White |
| 4,773,534 | A | 9/1988 | DeHeras et al. |
| 4,865,197 | A | 9/1989 | Craig |
| 5,010,988 | A | 4/1991 | Brown |
| 5,105,338 | A | 4/1992 | Held |
| 5,143,775 | A | 9/1992 | Olsson et al. |
| 5,160,001 | A | 11/1992 | Marceau |
| 5,175,876 | A | 12/1992 | Mendoza |
| 5,217,119 | A | 6/1993 | Hollingsworth |
| 5,494,157 | A | 2/1996 | Golenz et al. |
| 5,524,754 | A | 6/1996 | Hollingsworth |
| 5,570,780 | A | 11/1996 | Miller |
| 5,622,262 | A | 4/1997 | Sadow |
| 5,624,035 | A | 4/1997 | Kim |
| 5,725,090 | A | 3/1998 | Vermillion et al. |
| 5,769,232 | A | 6/1998 | Cash et al. |
| 5,843,501 | A | 12/1998 | Rubin et al. |

FOREIGN PATENT DOCUMENTS

| | | |
|---|---|---|
| DE | 004034038 A | 4/1992 |
| GB | 2186253 | 8/1987 |
| JP | 404128160 A | 4/1992 |
| NL | 7011399 | 2/1971 |
| WO | 9301106 | 1/1993 |

*Primary Examiner*—Shian Luong
(74) *Attorney, Agent, or Firm*—Kirk D. Houser; Eckert Seamans Cherin & Mellott, LLC

(57) ABSTRACT

A container has a wall member; a front panel; and a rear panel generally parallel to and spaced apart from the front panel. The front and rear panels are connected about their peripheries to the wall member which extends between the front and rear panels to define a volume. The rear panel, the front panel and the wall member is a unitary, blow molded member including a generally rigid shell, and a plurality of flexible membranes each of which has a periphery and a surface. The periphery of the flexible membranes is bonded to the generally rigid shell. The surfaces of the flexible membranes are separated from the generally rigid shell to form a plurality of unbonded areas between the surfaces of the flexible membranes and the generally rigid shell. Air is contained within the unbonded areas, thereby forming a plurality of air pockets between the flexible membranes and the generally rigid shell.

16 Claims, 6 Drawing Sheets

FIG. 1
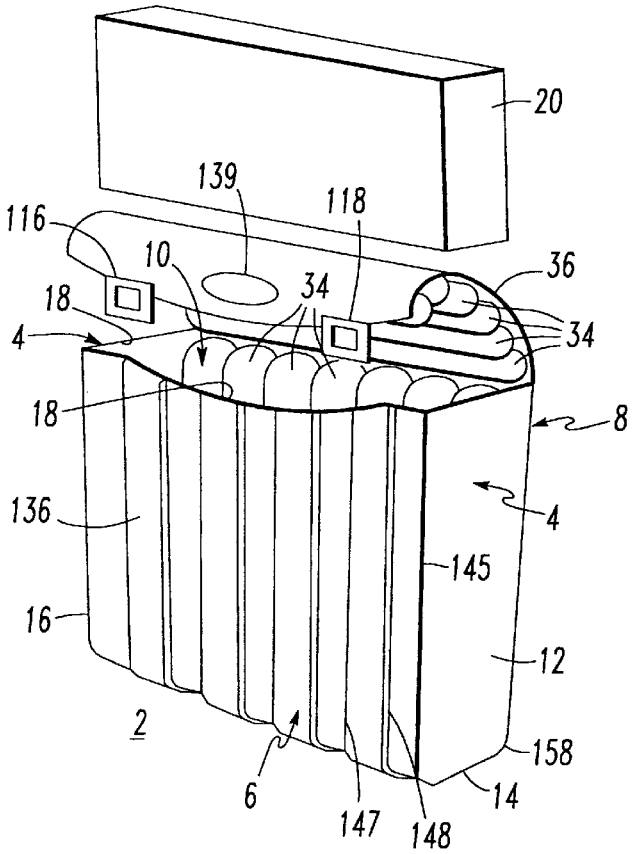
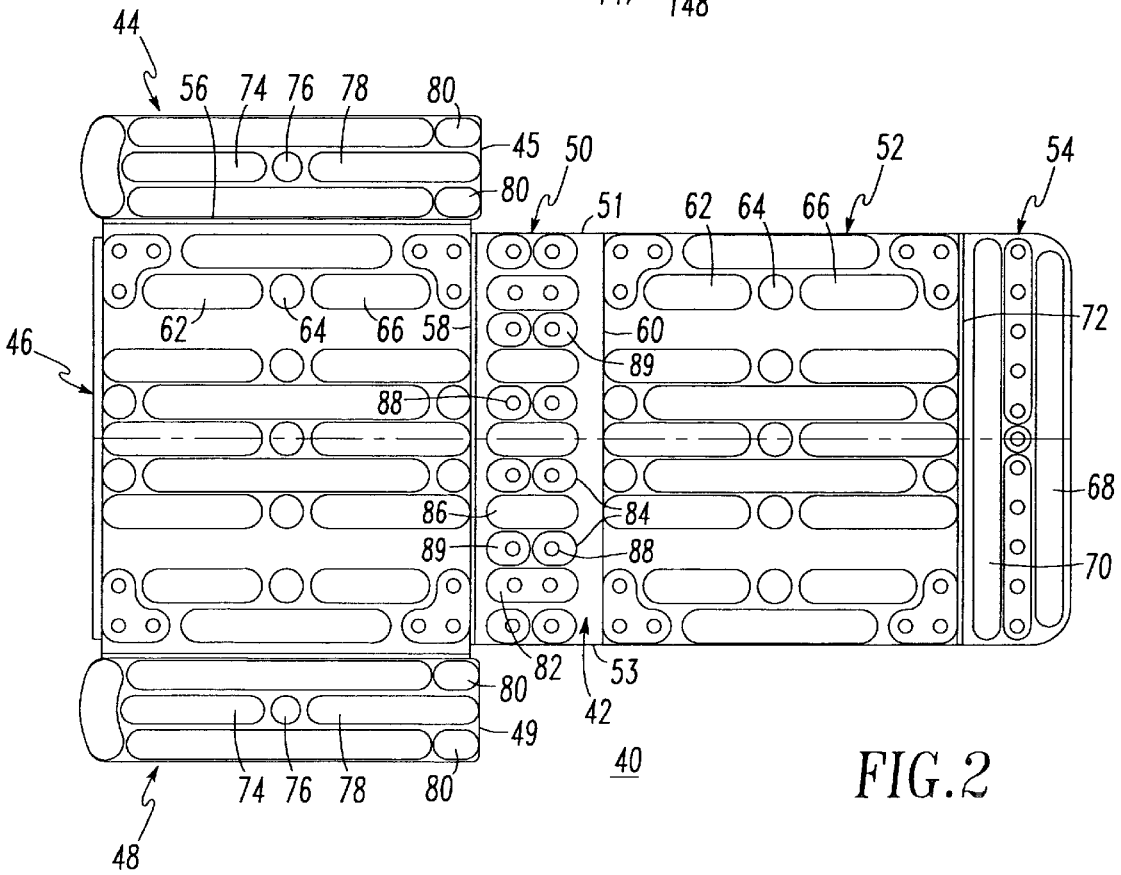
FIG. 2

FIG.3
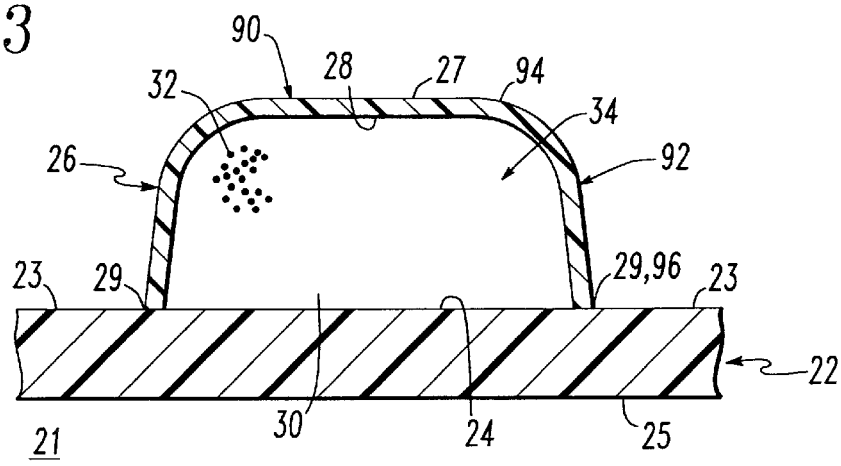
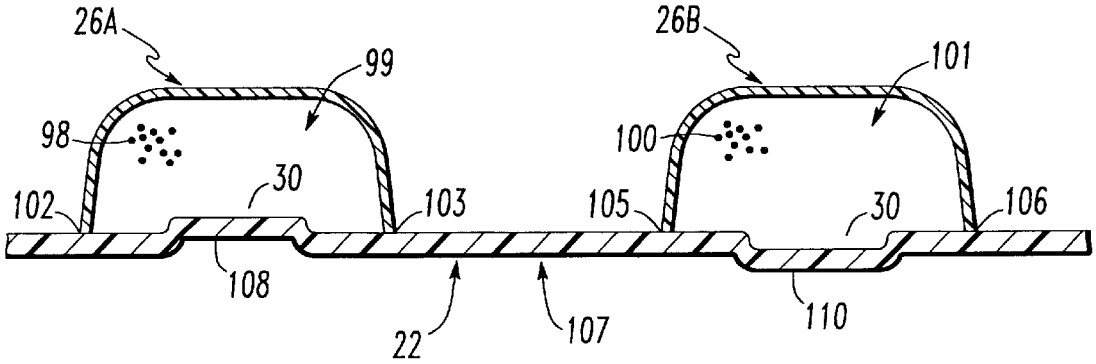
FIG.4
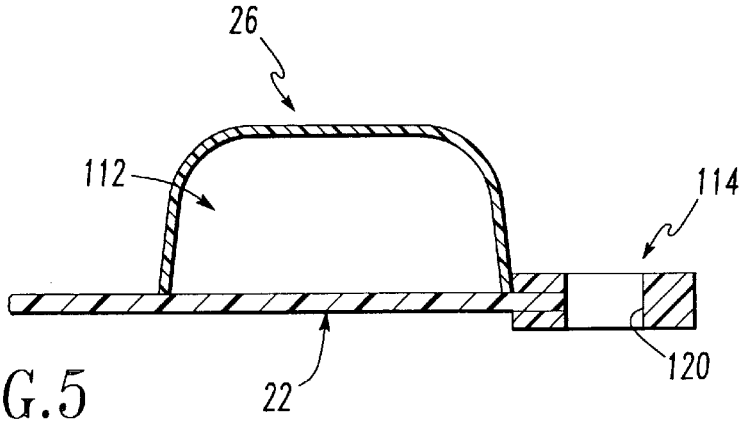
FIG.5

FIG.19
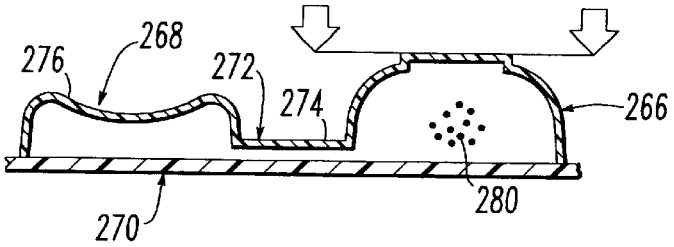
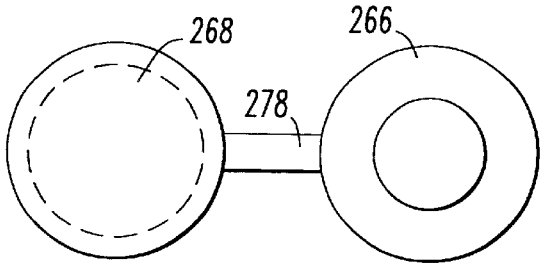
FIG.20
FIG.21
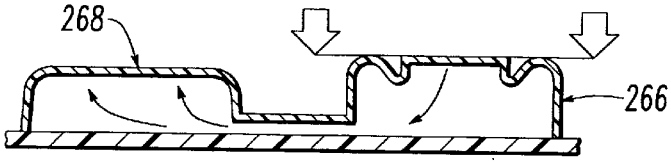
FIG.22
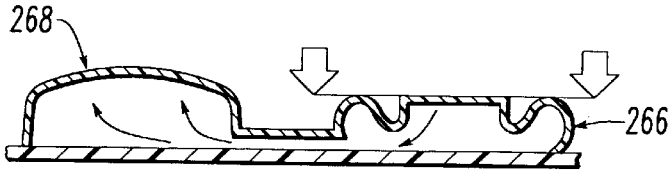
FIG.23
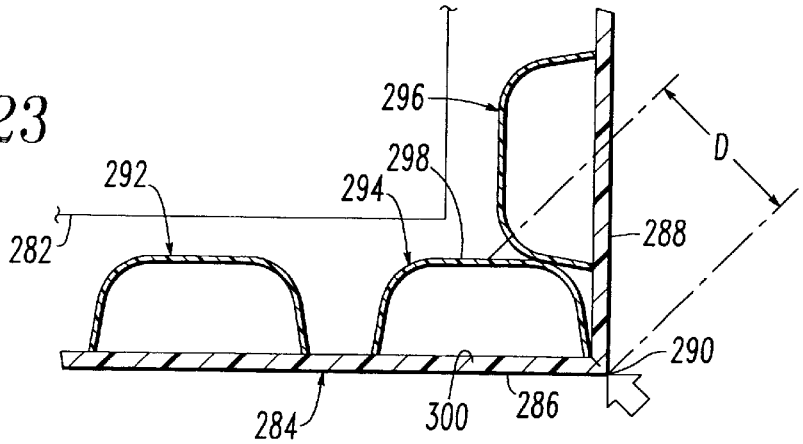

CONTAINER AND FOLDABLE PANEL EMPLOYING A PLURALITY OF GAS POCKETS

This is a divisional application of application Ser. No. 08/815,378, filed Mar. 11, 1997, now U.S. Pat. No. 6,149,002.

FIELD OF THE INVENTION

This invention relates to a container and, more particularly, to a container for protecting an article within the interior volume of the container. The invention also relates to a panel for forming a container and, more particularly, to a panel for forming a three dimensional container.

BACKGROUND INFORMATION

It is generally considered well known to employ conventional bubble packaging material (i.e., bubble wrap) for packaging or shipping a wide variety of materials and products. Bubble wrap is manufactured by a calendared extrusion process in which two sheets of a material of similar thickness are laminated into a single sheet having a plurality of uniform air pockets. Bubble wrap cannot be molded to a specific shape because it is a flexible sheet.

U.S. Pat. No. 4,773,534 discloses a folding printed circuit board transporter having a top, four sides, a bottom and a flap. In one embodiment, the transporter includes a structural outer layer having an outer surface held to an inner surface by a plurality of integral I-beam members. In other embodiments, the transporter also includes an inner layer of convoluted anti-static foam material, or an inner layer having a plurality of uniform open cells in a hexagonal pattern to provide cushioning and anti-static protection. The inner layer is adhered or glued to the inner surfaces of the transporter.

U.S. Pat. No. 3,744,627 discloses a package in which an article is placed on a plastic cushioning substrate and in which a second thermoplastic film is laminated to the cushioning substrate to enclose the article. The cushioning substrate is formed of a thin sheet of plastic material having a plurality of closely spaced uniform cellular protrusions formed therein. The cushioning substrate may have a recessed area to accept the article.

It is known to employ an inflatable device within a container to cushion an article therein. The inflatable device may use sheets of material (e.g., PVC) which are sonic or heat welded together around their perimeter.

U.S. Pat. No. 5,494,157 discloses a carrying case for a microcomputer. The carrying case employs a pad including an elongated tubular-shaped membrane having a compressible fill. Alternatively, the pad may include a gas impermeable fabric envelope filled with air or other gas under pressure to insulate the microcomputer from severe mechanical shocks.

U.S. Pat. No. 5,570,780 discloses a case for carrying a portable computer. The case includes a shell defining an interior recess, a rigid base and a rigid lid mounted on top of the base by a hinge. A plurality of inflatable bladders are secured to the interior surfaces of the base and another bladder is secured to the lid. Insertion of the computer within the interior recess partially collapses one bladder which pressurizes other bladders to tightly engage the computer within the recess.

U.S. Pat. No. 5,175,876 discloses a remote controller bag which houses a remote controller. The transparent bag has a front entrance opening to a central cavity for the controller, a rear end wall, right side wall, left side wall, cavity floor, bottom wall and top wall. Two pneumatic chambers are mounted within the cavity adjacent to, contiguous with and coextensive with the respective right and left walls, and in communication with the cavity floor and the top wall. The bottom wall has plurality of ribs which project to the bottom surface of the cavity floor and define pneumatic columns therebetween.

Inflatable devices for containers generally require inflation and/or subsequent valving of air chambers. This adds cost and decreases reliability. Furthermore, if multiple air chambers are interconnected and if one air chamber fails, then all of the interconnected air chambers fail.

Cases for carrying computers are well known. Examples are disclosed in U.S. Pat. Nos. 5,010,988; 5,105,338; 5,160,001; and 5,524,754.

Although it is known to employ a cushioning material within a container for an interior article to provide either a linear or an exponential deceleration of the article upon an exterior impact of the container, further improvements are possible.

There is a need, therefore, for an improved, low cost container for carrying an article.

SUMMARY OF THE INVENTION

This invention provides a container which holds an article, such as a laptop computer or video device, therein. The container employs a unitary member comprising a generally rigid shell and a plurality of flexible membranes. The flexible membranes form a plurality of gas containing pockets between the flexible membranes and at least one of the interior surfaces of the generally rigid shell.

The container comprises a wall member; a front panel; and a rear panel generally parallel to and spaced apart from the front panel, with the front and rear panels connected about their peripheries to the wall member which extends between the front and rear panels, thereby defining a volume. The wall member has at least one of a top portion and a bottom portion. Each of at least one of the rear panel, the front panel and the wall member comprises a unitary member comprising a generally rigid shell, and a plurality of flexible membranes each of which has a periphery and a surface, with the periphery of each of the flexible membranes bonded to the generally rigid shell and the surface of each of the flexible membranes separated from the generally rigid shell to form a plurality of unbonded areas between the surfaces of the flexible membranes and the generally rigid shell, and gas contained within the unbonded areas, thereby forming a plurality of pockets between the flexible membranes and the generally rigid shell.

Each of the pockets may include a generally flat surface generally parallel to the generally rigid shell, and a generally arcuate surface having a first periphery connected to the generally flat surface and a second periphery bonded to the generally, rigid shell. The gas of each of the pockets may be independent from the gas of each of the other pockets. As another aspect of the invention, at least one of the pockets is interconnected with at least another one of the pockets.

A number of preferred refinements include a generally rigid shell having a first thickness and a flexible membrane having a second thickness which is substantially less than the first thickness. The generally flat surface may include at least one nipple disposed thereon. Also, a plurality of nipples may be employed, with a first nipple disposed on the generally flat surface and a second nipple disposed on the first nipple. Some of the pockets provide a non-linear and non-exponential deceleration of an article within the volume of the container.

Preferably, some of the pockets are employed at the interior corners of the container, with a first pocket at about the corner and a second pocket offset from the corner by a first distance. The first and second pockets include a generally flat surface generally parallel to and about a second distance from the generally rigid shell. The first distance is preferably about equal to the second distance in order to provide impact protection for an article at the corner of the container.

As another aspect of the invention, a container comprises a wall member; a front panel; a rear panel generally parallel to and spaced apart from the front panel, with the front and rear panels connected about their peripheries to the wall member which extends between the front and rear panels; and partition means fixed in position within the volume dividing the volume into a plurality of compartments. The wall member has at least one of a top portion and a bottom portion. Each of at least one of the rear panel, the front panel and the wall member comprises a generally rigid shell, a plurality of flexible membranes each of which has a periphery and a surface, with the periphery of each of the flexible membranes bonded to the generally rigid shell and the surface of each of the flexible membranes separated from the generally rigid shell to form a plurality of unbonded areas between the surfaces of the flexible membranes and the generally rigid shell, and gas contained within the unbonded areas, thereby forming a plurality of pockets between the flexible membranes and the generally rigid shell, with at least some of the pockets supporting the partition means.

The partition means may be a generally rigid panel. In a preferred refinement, the partition means may include a generally rigid panel, a second flexible membrane, and a plurality of pockets between the second flexible membrane and the generally rigid panel. In another preferred refinement, the partition means may include a generally rigid panel having two sides, a pair of flexible membranes, and pockets between the flexible membranes and the sides of the generally rigid panel. Some of the pockets of the rear panel, front panel and wall member may include at least one first gas pocket parallel to and separated from at least one second gas pocket to define a channel therebetween. The partition means may have a first side and an opposing second side, with the partition means resting in the channel, the first gas pocket engaging the first side of the partition means, and the second gas pocket engaging the second side of the partition means.

As a further aspect of the invention, a generally flat panel which is foldable to form a three dimensional container comprises a generally flat, generally rigid, unitary member comprising a plurality of portions each of which are connected to an adjacent one of the portions along a folding line, a plurality of flexible membranes each of which has a periphery and a surface, the periphery of the flexible membranes bonded to at least one of the portions and the surface of the flexible membranes separated from such at least one of the portions to form a plurality of unbonded areas between the surfaces of the flexible membranes and such at least one of the portions, and gas contained within the unbonded areas, thereby forming a plurality of pockets between the flexible membranes and the generally flat, generally rigid, unitary member.

As a preferred refinement, the generally flat, generally rigid, unitary member may have a plurality of grooves or webs each of which defines a corresponding one of the folding lines. Also, one of the portions of the generally flat, generally rigid, unitary member may have a first flat portion, a second flat portion and a stepped parting line interconnecting the first and second flat portions.

Other details, objects, and advantages of the invention will become more apparent as the following description of a present preferred embodiment thereof proceeds.

BRIEF DESCRIPTION OF THE DRAWINGS

In the accompanying drawings, a present preferred embodiment of the invention is illustrated in which:

FIG. 1 is an isometric view of a container in accordance with the invention;

FIG. 2 is plan view of a generally flat panel which is foldable to form a three dimensional container in accordance with an embodiment of the invention;

FIG. 3 is a vertical sectional view of an air pocket formed between a generally rigid shell and a flexible membrane in accordance with an embodiment of the invention;

FIG. 4 is a vertical sectional view of a pair of air pockets for a container in accordance with another embodiment of the invention;

FIG. 5 is a vertical sectional view of an air pocket and a molded flange for a container in accordance with another embodiment of the invention;

FIG. 19 is a vertical sectional view of a pair of air pockets in accordance with another embodiment of the invention;

FIG. 20 is a plan view of the pair of air pockets of FIG. 19;

FIGS. 21–22 are vertical sectional views of the single nipple profile air pocket of FIG. 19 under two stages of increasing compression; and FIG. 23 is a vertical sectional view of a plurality of air pockets in accordance with another embodiment of the invention.

DESCRIPTION OF A PREFERRED EMBODIMENT

Figure 6:
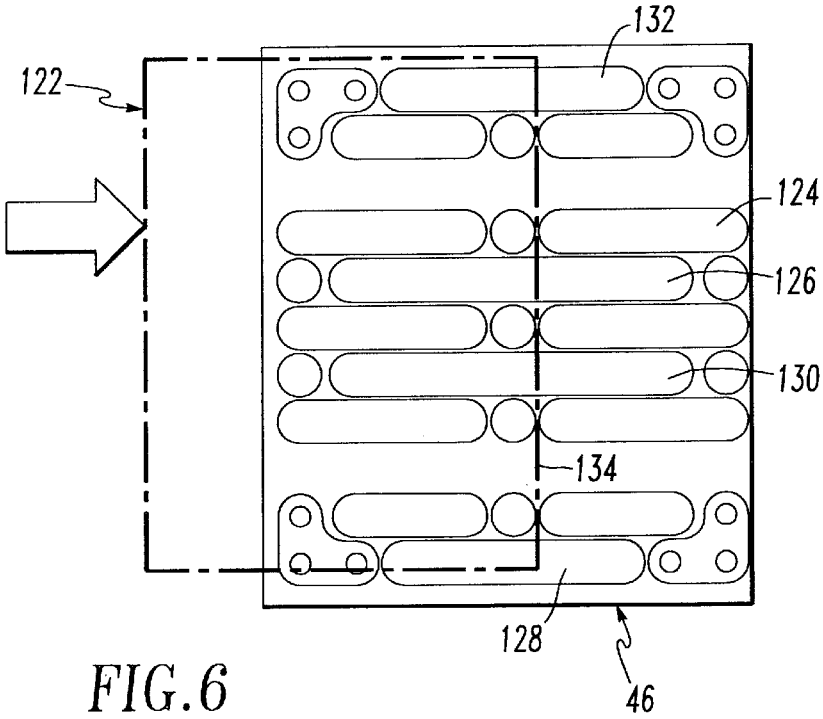
FIG. 6 is a plan view of a portion of the generally flat panel of FIG. 2 and a laptop computer.

As employed herein, the term "container" is intended to include, but shall not be limited to, carrying case, bag, luggage, and protective sleeve.

FIG. 1 illustrates a preferred embodiment of a container 2 in accordance with the invention. The container 2 includes a wall member 4, a front panel 6; and a rear panel 8. The rear panel 8 is generally parallel to and spaced apart from the front panel 6. The front and rear panels 6,8 are connected about their peripheries to the wall member 4 which extends between the front and rear panels 6,8, thereby defining a volume 10. The wall member 4 includes a right side portion 12, a bottom portion 14 and a left side portion 16. The exemplary container 2 has an opening 18 through which an article 20 may be inserted within the volume 10.

Referring to FIGS. 1 and 3, as shown with the rear panel 8 of FIG. 1, each of the rear panel 8, the front panel 6 and the wall member 4 comprises a unitary member 21 including a rigid shell 22 and a plurality of flexible membranes 26 (only one is shown in FIG. 3). The rigid shell 22 has an interior surface 23, an unbonded surface 24 and an exterior surface 25. The flexible membrane 26 has an interior surface 27, an unbonded surface 28 coextensive with the unbonded surface 24 of the rigid shell 22, and a bonded periphery 29 (e.g., formed in the process of blow molding the unitary member 21). Preferably, the rigid shell 22 and flexible membrane 26 are made of a plastic, such as polyethylene, although a wide range of suitable materials such as PVC, polypropelene and EVA may be employed. Preferably, the rigid shell 22 has a first thickness (e.g., 0.0762–0.127 cm (0.030–0.050 in.)) and the flexible membrane 26 has a second thickness (e.g., 0.0254–0.0381 cm (0.010–0.015 in.)) which is substantially less than the first thickness, although all dimensions herein are for purposes of illustration, but not limitation.

The unbonded surface 28 of the flexible membrane 26 is separated from the unbonded surface 24 of the rigid shell 22 to form an unbonded area 30 between the surfaces 24,28 of the rigid shell 22 and flexible membrane 26. The periphery 29 of the flexible membrane 26 is bonded to the rigid shell 22 during blow molding of the wall member 4, front panel 6 and rear panel 8 of FIG. 1. Contained within the unbonded area 30 is a gas 32, such as air, thereby forming a malleable air pocket 34 between the flexible membrane 26 and the rigid shell 22. Although the exemplary container 2 includes a plurality of air pockets 34 on each of its six interior surfaces, as shown with the rear panel 8 and top portion 36 of FIG. 1, the invention is applicable to containers which have plural air pockets on one or more interior surfaces.

The flexible top portion or flap 36 of the container 2 also includes a plurality of the air pockets 34. Preferably, the flexible flap 36 is blow molded along with the wall member 4, front panel 6 and rear panel 8. The flexible flap 36 is made of the same material as the rigid shell 22 and flexible membrane 26 of FIG. 3, and is blow molded to a suitable thinness for the desired flexibility. Other than the change from the rigid shell 22 of FIG. 3 to the flexible top portion 36, the construction of the air pockets 34 of the flexible top portion 36 is the same as discussed above in connection with FIG. 3.

Still referring to FIG. 1, the exemplary volume 10 approximates the shape of the exemplary article 20 which is an electronic device such as a laptop computer, although the invention is applicable to a wide range of articles (e.g., a camera; an electronic device such as a computer, video camera or video recorder; a music device; an optical device such as a pair of eyeglasses or camera; a firearm).

Referring to FIG. 2, a generally flat panel 40 is illustrated. The panel 40 is foldable to form a three dimensional container, similar to the container 2 of FIG. 1. The panel 40 includes a generally flat, generally rigid, unitary member 42 including six portions 44,46,48,50,52,54 each of which is connected to an adjacent one of such portions along a folding line, such as folding line 56 between portions 44,46. In the exemplary embodiment, portion 50 is connected to adjacent portion 46 along folding line 58 and, also, is connected to adjacent portion 52 along folding line 60. Each of the portions 44,46,48,50,52,54 includes a plurality of air pockets, such as air pockets 62,64,66 of portion 46. The general construction of the air pockets 62,64,66 of portion 46 is similar to the construction of the air pockets 34 discussed above in connection with FIG. 3, although significant differences may exist between some of the air pockets as discussed below.

The panel 40, when suitably folded, forms a three dimensional container, such as a protective sleeve for a laptop computer. In the panel 40, portion 46 is a front panel, portions 44,48 are side panels, portion 50 is a bottom portion, portion 52 is a back panel, and portion 54 is a top portion or flap. For example, when folded, end 45 of portion 44 is suitably fastened to end 51 of portion 50. Exemplary fastening devices (not shown) include fasteners, staples, stitches and welds such as heat welds. Similarly, the end 49 of portion 48 is suitably fastened to the other end 53 of portion 50. Also, the upper (with respect to FIG. 2) end of portion 52 is suitably fastened to upper end of portion 44, the lower end of portion 52 is suitably fastened to the lower end of portion 48, and portion 54 forms a flap. In that configuration, the portions 44,48,50,54 form a wall member with portions 44,48 positioned opposite each other and portions 50,54 positioned opposite one another when the flap portion 54 is closed. In the exemplary embodiment, each of the portions 44,46,48,50,52,54 of the member 42 are flat, although the invention is applicable to portions which are non-planar, such as the flap 36 of FIG. 1 which has a generally arcuate surface.

As shown in FIG. 2, a wide variety of air pocket sizes, shapes, profiles and configurations are possible. For example, in the three dimensional container formed from the panel 40, there are different load requirements on different interior areas of that container in an impact situation. As a result, the air pockets are varied, in terms of the thickness of the rigid member 42 and the height, shape and configuration of the air pockets, to preferably protect a particular type of article with a suitably effective array of dissimilar air pockets on the portions 44,46,48,50,52,54.

In the exemplary embodiment of FIG. 2, the largest areas generally require the least protection. The air pockets 62,64,66 of portions 46 and 52, which respectively form the front and back panels, have relatively shallow (e.g., 0.635 cm (0.25 in.)) air pockets. The portion 54, which forms the flexible top flap that folds over to close the container, has air pockets 68,70 running in the same orientation as folding line 72 to facilitate folding. The portions 44,48, which form the sides, have intermediate sized (e.g., 0.953 cm (0.375 in.)) air pockets 74,76,78. These portions 44,48 also have smaller sized air pockets 80 in the corners of the container, where additional support is needed, to provide firmer protection. The greatest protection is generally required at the bottom and its corners. Those areas employ relatively full (e.g., 1.27 cm (0.5 in.)) air pockets 82,84,86. The bottom air pockets 84 employ sprung nipples 88 (discussed below in connection with FIG. 15) having an additional height (e.g., 0.476 cm (0.188 in.)) above the upper surface 89 of the air pocket 84. As shown in FIG. 2, a wide range of air pocket shapes (e.g., circular, elongated, L-shaped) are employed with zero, one, two, three, or more nipples on the exemplary air pockets.

Figure 7:
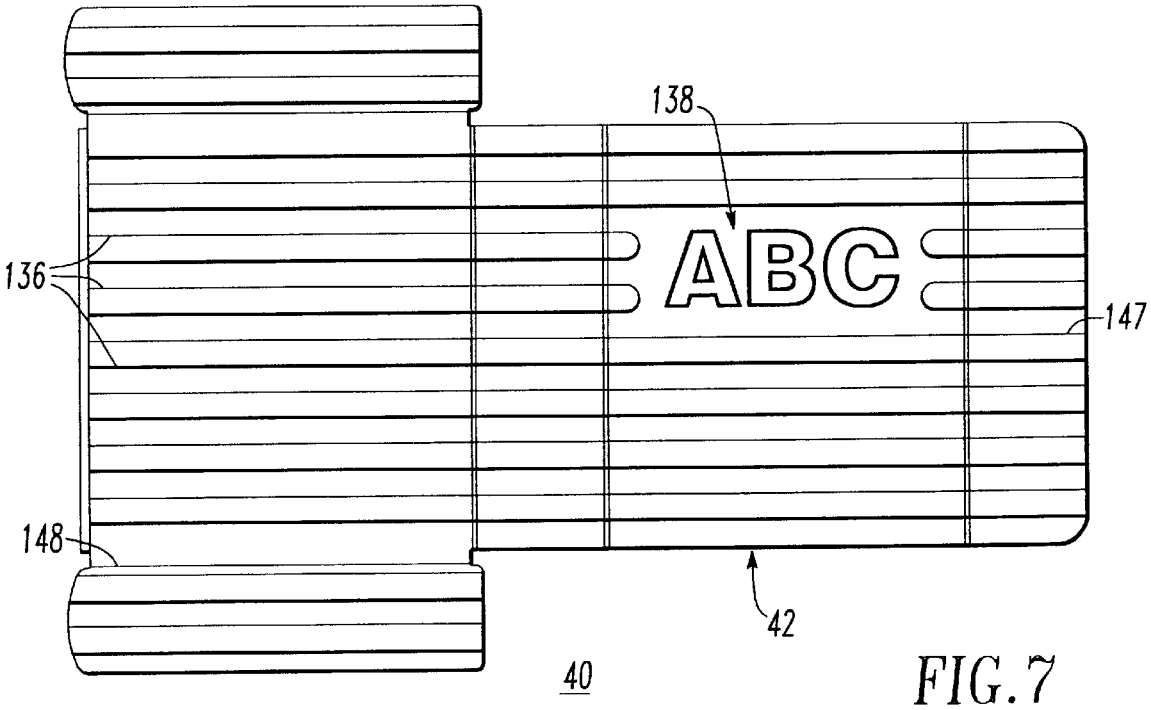
FIG. 7 is a plan view of the opposite side of the generally flat panel of FIG. 2.

The generally flat, generally rigid member 42 is preferably made of a suitable plastic which is formed by blow molding. The exterior surface of the member 42 may, for example, be plastic, plastic covered with fabric, or plastic covered with foam which is covered with fabric. Preferably, on the side of the blow mold (not shown) corresponding to the exterior surface (e.g., as shown in FIG. 7) of the member 42, a die cut or roll fed foam backed fabric is introduced into the mold in order that the member 42 is produced with a foam fabric backing. This provides a member which may be folded up into a container, while greatly reducing component costs and streamlining production efficiencies.

Preferably, the foam (not shown) is slightly smaller than the fabric (not shown) in order that the edges of the fabric adhere to the exterior of the member 42. Both the foam and the fabric may have either a polyethylene or a non-natural content. Preferably, the fabric has a blend of at least about 50 percent natural and less than about 50 percent synthetic material. The foam preferably is polyethylene with a melt temperature slightly greater than the material of the member 42 in order that these materials bond chemically in the blow molding machine. Furthermore, if a relatively thin (e.g., 0.0254–0.0305 cm (0.010–0.012 in.)) flange (not shown) is provided at the edges of the portions 44,46,48,50,52, stitches (not shown) in the fabric and the flanges may be employed to fasten such portions to form the container.

Preferably, on the side of the blow mold (not shown) corresponding to the interior surface (e.g., as shown in FIG. 2) of the member 42, a die cut or roll fed fabric (not shown) (e.g., a wool Lycra blend) is introduced into the mold in order that the member 42 is produced with a fabric backing, although other materials, such as velvet, may be applied to the flexible membrane 26 of FIG. 3 within the volume 10 of the container 2 of FIG. 1; the flexible membrane 26 may be left bare without a backing; or a liner connected to the opening 18, but not connected to the membrane 26, may be inserted within the volume 10 of the container 2.

Also referring to FIG. 3, the air pocket 34 formed by the flexible membrane 26 includes a generally flat surface 90, which is generally parallel to the rigid shell 22, and a generally arcuate surface 92. The surface 92 has a first periphery 94 connected to the generally flat surface 90 and a second periphery 96 bonded to the rigid shell 22.

As shown in FIG. 4, the gas 98 of air pocket 99 is independent from the gas 100 of the air pocket 101. The flexible membranes 26A and 26B are bonded to parts of the rigid shell 22 at bonds 102,103 and 105,106, respectively. The bonds 103,105, for example, maintain the independence of the gasses 98,100. Preferably, in terms of reliable operation of the air pockets, each of the air pockets of FIG. 2 are independent from the other air pockets.

The exemplary container 2 of FIG. 1 may take a wide variety of forms. For example, the exterior surface 107 of the rigid shell 22 of the container 2 may be embossed, as shown at 108, or de-bossed, as shown at 110, by molding. If the emboss/de-boss distance is preferably limited to about one to two times the thickness of the rigid shell 22, then the integrity of the rigid shell 22 is not measurably affected. As shown in FIG. 4, the emboss portion 108 and de-boss portion 110 are preferably molded at the unbonded areas 30, although such portions 108,110 may also be molded at the bonded areas 102,103,105,106 or between the air pockets 99,101.

Referring to FIG. 5, an air pocket 112 and a molded flange 114 for a container are illustrated. Unlike bubble wrap or inflatable devices, the exemplary air pockets formed between the rigid shell 22 and flexible membrane 26 may coexist with additional compression molded areas, such as the flange 114, which may serve as detail anchor points for fasteners or accessories (not shown). For example, as shown in FIG. 1, compression molded latches 116,118 are employed. As shown in FIG. 5, the molded flange 114 is thicker than the balance of the rigid shell 22 and, for purposes of illustration, but not limitation, has a hole 120 therethrough, to which, for example, a fastener strap or other accessory (not shown) may be attached. It will be appreciated by those skilled in the art that a wide range of simple to complex forms may be obtained by blow molding of the panel 40 of FIG. 2.

FIG. 6 illustrates the portion 46 of the member 42 of FIG. 2 and a laptop computer 122 (shown in phantom line drawing) partially inserted within the container (not shown) formed by the member 42. By employing offset air pockets, such as 124,126, the laptop computer 122 slides (from left to right in FIG. 6) into the container without snagging on individual air pockets. As shown, the air pockets 128,130, 126,132 support the end 134 of the laptop computer 122, in order that the end 134 does not snag on the ends of other air pockets, such as 124.

Referring to FIG. 7, the exterior side of the generally flat panel 40 of FIG. 2 is illustrated. Preferably, the strength of the shell is biased to either the vertical or horizontal direction (with respect to FIG. 7) by emboss/de-boss ribs 136, such as the emboss portion 108 and de-boss portion 110 of FIG. 4. In the exemplary embodiment, the ribs 136 run parallel with the elongated air pockets (e.g., air pockets 124,126,128,130,132 of FIG. 6). Alternatively, ribs (not shown) may run at a 90° angle with respect to the elongated air pockets in order to provide improved bi-axial shell strength. A wide range of informative information (e.g., instructions, warning notifications, logos or pictures), such as at 138, or decorative information, such as at 139 (FIG. 1), may be introduced.

Figure 8:
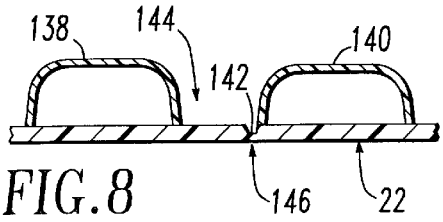
FIGS. 8–9 are vertical sectional views of a pair of air pockets for a container in accordance with another embodiment of the invention.
Figure 9:
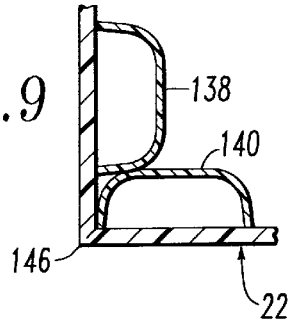

FIGS. 8–9 illustrate a pair of adjacent air pockets 138,140 on the rigid shell 22. As shown in FIG. 8, a suitably thin groove 142 is formed in the rigid shell 22 between the surface 144 and the air pocket 140. As shown in FIG. 9, the groove 142 permits the rigid shell 22 to be folded along folding line 146. Grooves, such as 142, are preferably employed to provide a notched crease 145, as shown with the container 2 of FIG. 1. A variety of exterior and/or interior grooves are employed. For example, as shown in FIG. 7, single groove 147 runs the full length of the exterior surface, while multiple groove 148 runs part of the length of the exterior surface. It will be appreciated that grooves 147,148 may also be employed to form, for example, the contoured front panel 6 as shown in FIG. 1.

Figure 10:
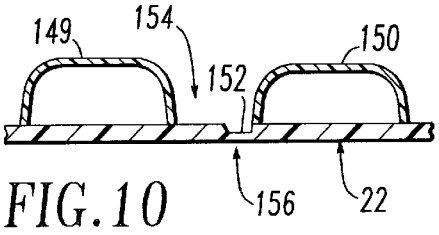
FIGS. 10–11 are vertical sectional views of a pair of air pockets for a container in accordance with another embodiment of the invention.
Figure 11:
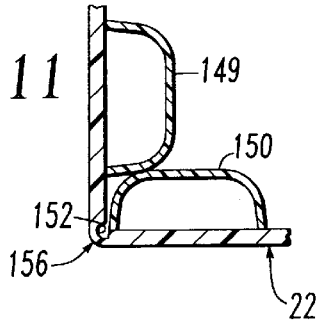

FIGS. 10–11 illustrate a pair of adjacent air pockets 149,150 on the rigid shell 22. As shown in FIG. 10, a suitably thin web 152, such as a thin portion (e.g., 0.0254–0.0305 cm (0.010–0.012 in.)) of the shell 22, connects the rigid shell 22 between the surface 154 and the air pocket 150. As shown in FIG. 11, the web 152 permits the rigid shell 22 to be folded along folding line 156. Webs, such as 152, are preferably employed to provide a relatively soft radius 158 (as shown with the container 2 of FIG. 1) as contrasted to the relatively abrupt crease 145. It will be appreciated that grooves and webs may also be employed to form, for example, pockets, flaps or doorways in a container.

Figure 12:
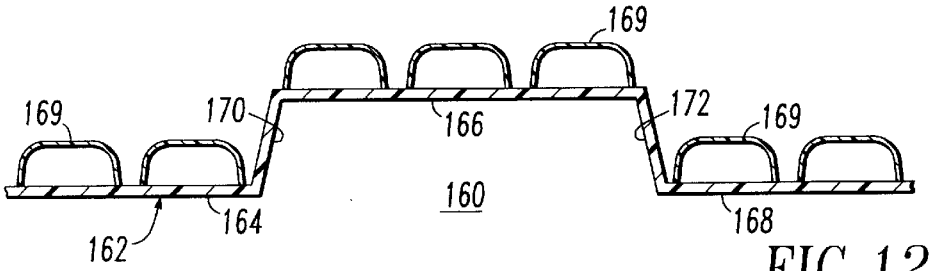
FIG. 12 is vertical sectional view of a portion of a generally flat panel in accordance with another embodiment of the invention.

FIG. 12 is a vertical sectional view of a portion of a generally flat panel 160, which is somewhat similar to the generally flat panel 40 of FIG. 2. The panel 160 includes a generally flat, generally rigid member 162, which has a first flat portion 164, a second flat portion 166 and a third flat portion 168, and a plurality of air pockets 169. Stepped parting lines 170 and 172 respectively interconnect the first and second flat portions 164,166, and the second and third flat portions 166,168. Although the panel 40 is typically molded approximately flat, as discussed above in connection with FIG. 2, a range of parting line movement is possible. For example, the stepped parting lines 170,172 are useful when a step or semi-partition is desirable (e.g., within a camera case or bag).

Figure 13:
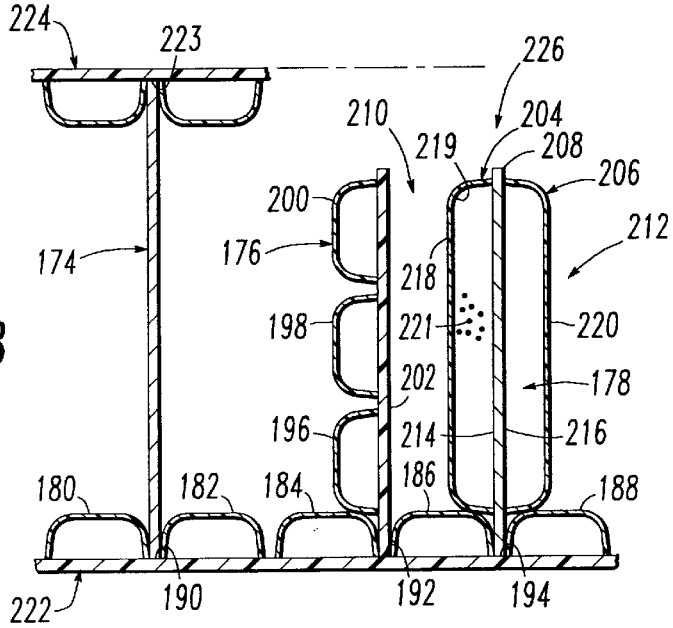
FIG. 13 is vertical sectional view of a portion of a container having partitions in accordance with another embodiment of the invention.

FIG. 13 illustrates a vertical sectional view of a portion of a container having partitions 174,176,178. The air pockets 180,182,184,186,188 of the container are employed to form partition channels 190,192,194. The air pocket 180, for example, is parallel to and separated from the air pocket 182 to form partition channel 190. The partition 174 rests in the channel 190, with the air pocket 180 engaging the left side (with respect to FIG. 13) of the partition 174 and the air pocket 182 engaging the right side of the partition 174. The partitions 174,176,178 are fixed in position by the respective channels 190,192,194 within the volume of the container and divide the container into a plurality of compartments.

The partition 174 is a rigid panel which is preferably similar to the rigid shell 22 of FIG. 3, although any suitably rigid material may be employed. The partition 176 includes a plurality of air pockets 196,198,200 disposed on one side of a rigid panel 202. The partition 176 may be formed in a similar manner as discussed with the air pocket 34 of FIG. 3.

The partition 178 includes a pair of elongated air pockets 204,206 disposed on opposite sides of a rigid panel 208. The partition 178 is formed in a similar manner as discussed with the air pocket 34 of FIG. 3, except that the air pockets 204,206 are somewhat larger, with at least one on each side of the panel 208. The partition 178 is employed to provide two compartments 210,212 in the container, when it is necessary to protect articles, at the common partition boundary of the compartments 210,212.

The panel 208 has a first side 214 and a second side 216. A flexible membrane 218 has a surface 219 coextensive with at least part of the side 214 of the panel 208. The periphery of the flexible membrane 218 is bonded to the panel 208 and the surface 219 of the flexible membrane 218 is separated from the panel 208 to form an unbonded area between the surface 219 of the flexible membrane 218 and the panel 208. Gas 221 is contained within the unbonded area, thereby forming the air pocket 204 between the flexible membrane 218 and the side 214 of the panel 208. The elongated air pocket 206 on the other side of the panel 208 is formed with the flexible membrane 220 in a similar manner as discussed with the flexible membrane 218.

The exemplary partition 174 extends between a pair of channels 190,223 of respective panels 222,224, such as, for example, between the front panel 6 and the rear panel 8 of FIG. 1, or between a top portion and a bottom portion of a container. The exemplary partitions 176,178 have less than a full partition length in order that there are, for example, two compartments 210,212 at the panel 222 end of the container and one compartment 226 (e.g., above partition 178 in FIG. 13) at the panel 224 end of the container. It will be appreciated that a wide variety of partition configurations are possible within the volume of the container.

Figure 14:
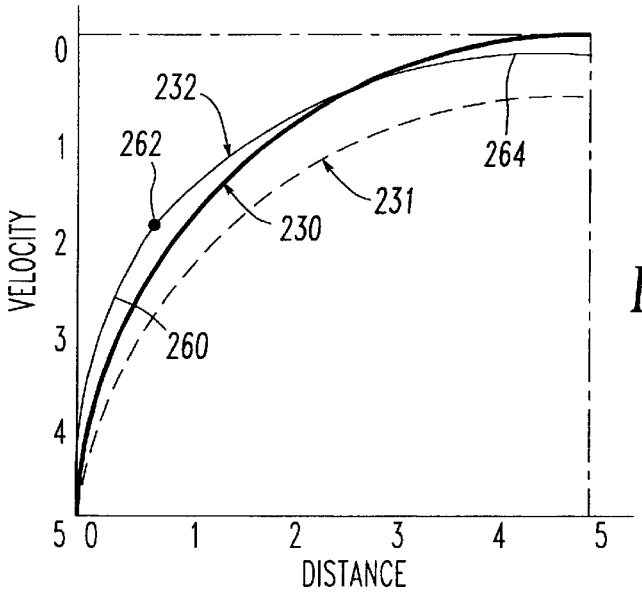
FIG. 14 is a plot of relative deceleration velocity versus distance for compressed air deceleration, ideal deceleration, and anticipated deceleration in accordance with an embodiment of the invention.

Referring to FIG. 14, plot 230 is the ideal relative deceleration velocity versus distance for an article in a container which is dropped. Plot 231 is the relative deceleration velocity versus distance for compressed air. Plot 232 is believed to represent relative deceleration velocity versus distance for an article in a container, in accordance with the present invention, which is dropped. Plots 230 and 232 lengthen the period of the initial deceleration with respect to plot 231 (compressed air). Plot 232 further lengthens the period of the initial deceleration with respect to plot 230 (ideal), although the subsequent deceleration after point 262 is reached, like that of plot 231, is a bit faster than plot 230.

The following describes forces involved when a container (e.g., a computer or camera bag) holding an article (e.g., a computer or camera) therein is dropped onto a hard floor. These descriptions are provided from the point the container touches the floor (i.e., when the container stops moving) to the point the article within the container stops moving. For example, if a container with a conventional foam cushion is employed, deceleration is approximately linear and the article within the container is still decelerating when the article hits the inside of the container, where it abruptly stops. In this instance, damage to the article may occur. If two layers of conventional foam, of different densities, would be employed, initial deceleration would be at a first rate, followed by deceleration at a second smaller rate. In this example, the article within the container would still be decelerating when the article hits the inside of the container, where it abruptly stops.

Compressing air is a better method for deceleration than foam, because air is non-linear when compressed. Air compresses exponentially (i.e., in a 0.5 per unit volume it has twice the air pressure than in a per unit volume; in a 0.25 per unit volume it has eight times the pressure). By initially decelerating lightly, followed by increased deceleration, and continuing to decelerate at a faster rate, an article is abruptly stopped without impacting the inside of its container. This method is better than foam in terms of obviating impact, although the deceleration is abrupt. In contrast, interconnected air pockets alone do not practically offer a non-linear rate of compression.

Figure 15:
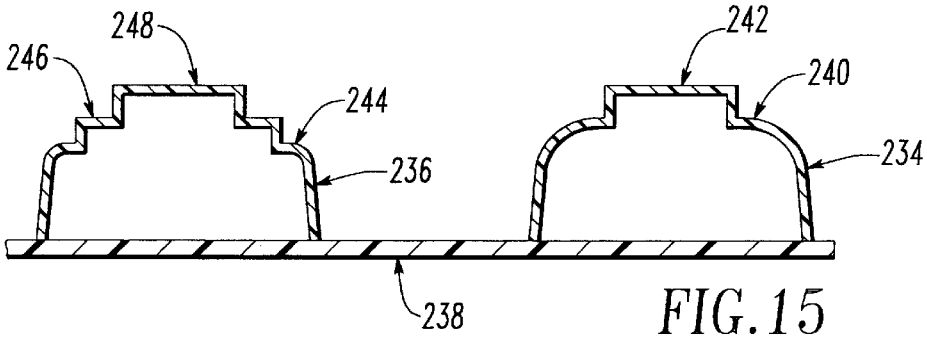
FIG. 15 is a vertical sectional view of an air pocket having a single nipple profile and another air pocket having a double nipple profile in accordance with embodiments of the invention.

FIG. 15 illustrates an air pocket 234 employing a single nipple profile and an air pocket 236 employing a double nipple profile. The air pockets 234,236 are disposed on a rigid panel 238 in a similar manner as discussed above in connection with FIG. 3. The generally flat surface 240 of the air pocket 234 includes a single nipple 242 disposed thereon, although the invention is applicable to air pockets having a plurality of nipples. The generally flat surface 244 of the air pocket 236 includes two nipples 246,248, with the first nipple 246 disposed on the generally flat surface 244 and the second nipple 248 disposed on the first nipple 246.

A non-linear, non-exponential rate of compression may suitably be approximated by employing an air pocket which compresses air with a profile that lessons the exponential nature of the air. One or more non-linear, non-exponential air pockets are preferably employed to provide a non-linear, non-exponential deceleration which approaches the ideal deceleration of plot 230 of FIG. 14.

Figure 16:
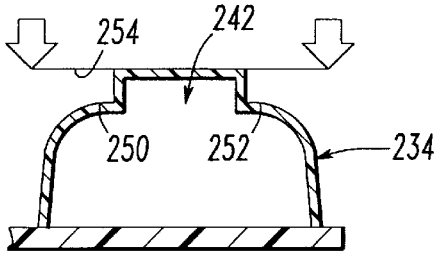
FIGS. 16–18 are vertical sectional views of the single nipple profile air pocket of FIG. 15 under three stages of increasing compression.
Figure 17:
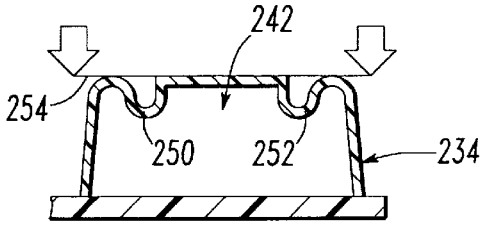
Figure 18:
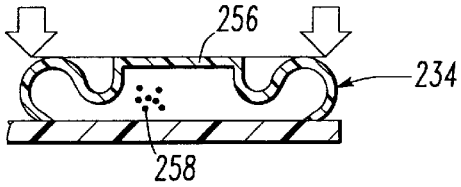

Referring to FIGS. 16–18, the single nipple profile air pocket 234 of FIG. 15 is shown under three stages of increasing compression. In the exemplary embodiment of FIG. 15, the relatively small area of the nipple 242 bears a greater pressure point and, therefore, compresses sooner than if it were flat (e.g., similar to the generally flat surface 90 of FIG. 3). Aiding this initial soft compression are flats 250,252 on either side (as shown in the vertical sectional view of FIG. 16) of the nipple 242. As shown in FIGS. 16 and 17, when the surface 254 of an article applies pressure to the nipple 242, the flats 250,252 are predisposed to collapse (as shown in FIG. 17).

In a first stage of compression (shown in FIG. 17), once the nipple 242 is fully compressed to the level of the adjacent flat surface 240 (shown in FIG. 15), with the flat surface 254 pressing thereagainst, the nipple 242 moves no lower than the surface 240. In a second stage of compression (shown in FIG. 18), the main chamber 256 of the air pocket 234 begins to compress. This has the practical effect of moving the exponential compression nature of the air 258 further up the deceleration plot where it does the most good, while providing a more gradual and longer deceleration at the beginning of the deceleration period. It will be appreciated that the period of more gradual deceleration may be further extended by employing additional nipples (e.g., a total of two, three or more) as shown with the double nipple profile of the air pocket 236 of FIG. 15.

Referring again to FIG. 14, the anticipated deceleration plot 232 approximates the ideal plot 230 in which initial deceleration is light to avoid jarring, followed by progressively heavier deceleration. In the initial portion 260 of the plot 232, the nipple 242 is compressed until it reaches maximum compression at point 262 of the plot 232. This is followed by residual exponential compression in the latter portion 264 of the plot 232.

The ideal non-linear, non-exponential deceleration of the plot 230 may suitably be approximated by employing plural nipple profile air pockets to provide the appropriate protection for a selected article of specific weight over a typical drop distance. For example, plural air pockets designed for a relatively heavy video camera would be different than those designed for a relatively light 35 mm camera.

In terms of cost, the preferred gas 258 of FIG. 18 is air, although various other gases, such as nitrogen, or combinations of gases may also be employed.

FIG. 19 illustrates a pair of air pockets 266,268. The air pockets 266,268 are disposed on a rigid panel 270 with other air pockets (not shown) in a similar manner as discussed above in connection with FIG. 3. The air pocket 266 is interconnected with the air pocket 268 at 272 which is an unbonded portion of the flexible membrane 274. Preferably, the air pocket 266 has a suitable nipple profile, while the air pocket or chamber 268 has an upper surface 276 having a concave shape. As shown in FIG. 20, the air pocket 266 has a conduit 278 interconnected with the air pocket 268. When the air pocket 266 is compressed (as shown in FIGS. 19, 21 and 22), the air 280 of the air pocket 266 flows through the conduit 278 to the air pocket 268. It will be appreciated that the stages of increasing compression of the air pocket 266 in FIGS. 21 and 22 are similar to the stages of increasing compression of the air pocket 234 in FIGS. 17 and 18, respectively. Concurrently with the compression of the air pocket 266, the upper surface 276 of the air pocket 268 expands from the exemplary concave shape of FIG. 19, to the flat surface of FIG. 21, and to the convex surface of FIG. 22.

By employing the remote chamber 268 annexed to the load bearing chamber 266 through the connection conduit 278, an extended deceleration period may be provided for certain applications. For example, this configuration is preferable employed at the interior corner of the container in order to lengthen the period of deceleration of the article contained therein. Although the exemplary air pocket 266 employs a single nipple profile, it will be appreciated that different profiles with a plurality of nipples may be used.

Referring to FIG. 23, a video device, such video camera 282, is positioned within the volume of a container 284. The container 284 has a front panel 286 and a wall member 288, which is normal to the front panel 286, thereby defining a corner 290 of the container 284. The container also has air pockets 292,294 disposed on the interior surface of the front panel 286 and an air pocket 296 disposed on the wall member 288. The air pockets 292,294,296 are disposed on the front panel 286 and wall member 288 with other air pockets (not shown) in a similar manner as discussed above in connection with FIG. 3.

The air pocket 294 is at about the corner 290 and the air pocket 296 is offset from the corner 290 by an offset distance. The air pocket 294 has a generally flat surface 298 parallel to a generally rigid shell 300. As shown in FIG. 23, the distance from surface 298 to the shell 300 is preferably about equal to the offset distance. In order to properly design for an impact situation at the corner 290, a maximum distance D, equal to about $\sqrt{2}$ times the offset distance, may be obtained to provide optimal impact protection for the exemplary video camera 282 at the corner 290 of the container 284.

The exemplary container 2 and folding panel 40 are both practical, in terms of integrating the capabilities disclosed herein, as well as cost effective, in terms of blow molding a unitary member including a rigid shell and a plurality of flexible membranes. The interior malleable air pockets are disposed against a harder shell backing. The exterior shell may be made practically impervious to penetration while the interior air pockets may be as thin, flexible and gossamer-like as needed. The container may be subjected to certain impacts or carried in luggage, such as a briefcase, without damaging the article in transit. The exemplary shell and dissimilar air pockets have special properties which may be custom tailored to meet specific requirements in terms of stiffness and puncture resistance of the exterior shell, which may have flat and/or contoured portions of suitable thickness, and interior protection of the enclosed article as provided by the interior dissimilar air pockets configured in a suitable arrangement and softness. A wide range of articles may be protected, although the exemplary container and folding panel preferably protect an expensive and/or fragile article that is portable by nature.

Whereas particular embodiments of the present invention have been described above for purposes of illustration, it will be appreciated by those skilled in the art that numerous variations in the details may be made without departing from the invention as described in the appended claims.

What is claimed is:

1. A container comprising:

a wall member;

a front panel; and a rear panel generally parallel to and spaced apart from said front panel, with said front and rear panels connected about some of their peripheries to said wall member which extends between said front and rear panels, thereby defining a volume, wherein said wall member has two side portions and at least one of a top portion and a bottom portion, and wherein at least one of said rear panel, said front panel and said wall member comprises:

a unitary member comprising:

a generally rigid shell having a surface, and a plurality of flexible membranes each of which has a periphery and a surface, the periphery of each of said flexible membranes bonded to said generally rigid shell and the surface of each of said flexible membranes separated from said generally rigid shell to form a plurality of unbonded areas between the surfaces of said flexible membranes and said generally rigid shell, and gas contained within the unbonded areas, thereby forming a plurality of pockets between said flexible membranes and said generally rigid shell, wherein one of said front and rear panels is about normal with respect to said wall member, thereby defining a corner of said container;

wherein one of said wall member and said one of said front and rear panels has a first pocket with a portion of the periphery of a corresponding one of the flexible membranes being at or substantially at said corner;

wherein the other of said one of said wall member and said one of said front and rear panels has a second pocket offset from said corner by a first distance;

wherein each of said first pocket and said second pocket offset from said corner comprises:

a generally flat surface generally parallel to and about a second distance from the surface of said generally rigid shell, and a generally arcuate surface having a first periphery connected to said generally flat surface and a second periphery bonded to said generally rigid shell; and wherein the first distance is about equal to the second distance in order to provide impact protection for an article at the corner of said container.

2. The container of claim 1, wherein said wall member has the top portion and the bottom portion; and wherein the top portion and the bottom portion are positioned opposite one another.

3. The container of claim 2, wherein each of said rear panel, said front panel and the bottom portion of said wall member comprises: said unitary member, and said gas.

4. The container of claim 3, wherein the top portion of said wall member comprises: said unitary member, and said gas.

5. The container of claim 2, wherein said flexible membranes are first flexible membranes; wherein said unbonded areas are first unbonded areas; and wherein the top portion of said wall member comprises:

a flexible panel having a first thickness, a plurality of second flexible membranes each of which has a second thickness which is substantially less than the first thickness, a periphery and a surface, the periphery of said second flexible membranes bonded to said flexible panel and the surface of said second flexible membranes separated from said flexible panel to form a plurality of second unbonded areas between the surface of each of said second flexible membranes and said flexible panel, and gas contained within the second unbonded areas, thereby forming a plurality of pockets between said second flexible membranes and said flexible panel.

6. The container of claim 1, wherein said generally rigid shell has a first thickness; and wherein said flexible membranes have a second thickness which is less than the first thickness.

7. The container of claim 6, wherein the second thickness is substantially less than the first thickness.

8. The container of claim 1, wherein said gas is air; and wherein said pockets are malleable air pockets.

9. The container of claim 1, wherein the gas of each of said pockets is independent from the gas of each of the other of said pockets.

10. The container of claim 1, wherein said front and rear panels and said wall member define said volume to approximate a shape of an electronic device.

11. The container of claim 10, wherein said front and rear panels and said wall member define said volume to approximate a shape of a computer.

12. The container of claim 1, wherein said front and rear panels and said wall member define said volume to approximate a shape of a camera.

13. The container of claim 1, wherein each of at least some of said pockets comprises:

a generally flat surface generally parallel to said generally rigid shell; and a generally arcuate surface continuous with said generally flat surface and a periphery bonded to said generally rigid shell.

14. The container of claim 1, wherein some of said pockets are offset with respect to others of said pockets.

15. The container of claim 1, wherein said container has an exterior surface and an interior surface; wherein the surface of said flexible membranes is a first surface; wherein said flexible membranes have a second surface which forms part of said interior surface; and wherein said generally rigid shell has a first surface which forms part of said interior surface and a second surface which forms part of said exterior surface.

16. The container of claim 1 wherein the generally flat surface of said first pocket has a center which is a third distance from said corner; and wherein said third distance is about $\sqrt{2}$ times said first distance.

* * * * *